US005624009A

United States Patent [19]

Benjamin et al.

[11] Patent Number: 5,624,009

[45] Date of Patent: Apr. 29, 1997

[54] WHEELCHAIR LIFT

[76] Inventors: Kevin S. Benjamin, 89 Lynn St., Portland, Me. 04103; Kurt H. Cushwa, 1118 Hamilton Blvd., Hagerstown, Md. 21740

[21] Appl. No.: 601,423

[22] Filed: Feb. 14, 1996

Related U.S. Application Data

[63] Continuation-in-part of Ser. No. 268,860, Jun. 30, 1994, abandoned.

[51] Int. Cl.[6] ..... B66B 9/08

[52] U.S. Cl. ..... 187/201; 414/921

[58] Field of Search ..... 187/200, 201; 414/721

[56] References Cited

U.S. PATENT DOCUMENTS

| | | | |
|---|---|---|---|
| 3,229,788 | 1/1966 | Booth | 187/201 |
| 4,155,468 | 5/1979 | Royce | 414/921 |
| 4,674,601 | 6/1987 | Benjamin | 414/921 |
| 4,904,916 | 2/1990 | Gisske et al. | 187/201 |

FOREIGN PATENT DOCUMENTS

| | | | |
|---|---|---|---|
| 0047574 | 3/1982 | European Pat. Off. | 187/201 |

*Primary Examiner*—Kenneth Noland

*Attorney, Agent, or Firm*—Chris A. Caseiro; Thomas L. Bohan

[57] ABSTRACT

A wheelchair lift system enabling wheelchair accessibility between stair levels for persons incapable of traversing stairs under their own power. The key of the invention is a free-rolling, wheeled platform suspended between two arcuate tracks which are lifted and lowered by synchronized, reversible, worm-gear drive mechanisms. The platform and tracks are mounted on a frame in which also resides peripheral equipment needed to raise and lower the system. A seven-foot-high portal frame supports the drive mechanism which comprises pivoting, worm-gear type drive motors, turning long worm-gears extending vertically downward from the top of the frame to the floor and engaging pivoting worm-gear heads that are attached to the arcuate tracks, while allowing normal access to the stairs.

16 Claims, 6 Drawing Sheets

WHEELCHAIR LIFT

This is a continuation-in-part of application Ser. No. 268,860, filed Jun. 30, 1994, now abandoned.

BACKGROUND OF THE INVENTION

1. Field of the Invention

The present invention relates to a wheelchair lift system facilitating transit between different horizontal levels for persons otherwise unable to make the transit unassisted. A particular embodiment of this invention is coupled to stairways and is used to accommodate persons incapable of traversing stairs unassisted. More particularly, this invention allows for a safe transit up or down a stairway for those persons who are capable of traveling about on a level floor yet have difficulty negotiating stairs, such persons including but not limited to, cardiac patients, "walker" patients, and patients in wheelchairs. Yet more particularly, this invention relates to a novel system allowing for the smooth transit between horizontal elevations using a rolling platform in conjunction with tracks which are varied in elevation by means of a motor coupled to the tracks without using cables, a motor that can be activated by a wheelchair occupant or other user without any assistance. Most particularly, the preferred embodiment of the present invention uses worm-gears arrayed in such a way as to allow for a safe return to the lower level in the event of a power failure. Finally, the wheelchair lift system of the present invention, when installed on a stairway as to the preferred embodiment, does not prevent that stairway from being traversed in its normal manner.

2. Description of the Prior Art

Motorized lift systems for stairways have been around for a long time, serving to transport persons incapable of otherwise negotiating stairs. Most such systems had to be custom-made for particular locations and stairs. For instance, the most common lift system for transporting persons up a set of stairs used a fixed rail which in turn was attached to a stairway wall somewhat like a very strong bannister. The fixed rail was custom-manufactured to fit the entire run of stairs upon which it would be used. A lifting chair was attached to the rail and the chair moved between levels using a motorized cabling system or using a direct-drive motor attached to the chair itself. For a wheelchair-bound person, this system required, generally, that the person be physically transferred out of a wheelchair and into the movable chair, and then, after the person traversed the stairs, that he or she be removed from the lift chair and placed into either a second wheelchair or into the first wheelchair which would have been carried by an attendant the length of the stairway.

More recent lift systems have been devised that are portable, self-contained devices adaptable to almost any stairs encountered. U.S. Pat. No. 3,229,788 (1966, Booth) teaches such a system. Booth provides a wheelchair-supporting platform riding on wheels engaged in a track and controlled by a motorized cabling system. For motive force, Booth uses two reversible electric motors. Each motor is connected to a reduction gear box coupled to the axle of a drum onto which is affixed one end of a cable. This cable is then threaded around a series of pulleys, including those rotatably mounted to a wheel axle of the platform, and secured to the upper end of the track on which the wheels rest. In order to lift the platform along the track, the drum is rotated so as to draw the cable shorter. The entire system of motors, gear box, and pulleys is secured to the lifting platform.

Another system, more closely antecedent to the present invention, is that of U.S. Pat. No. 4,674,601 (1987, Benjamin). Benjamin describes an apparatus for enabling wheelchair-confined individuals to more easily convey themselves between two different elevations, especially between the inside ground level of a house and the outside ground level. The key to Benjamin is a unitary molded arcuate lift or scoop on which the wheelchair rides while being conveyed between the two levels. As the scoop rotates up, the wheelchair rolls forward and eventually onto the upper level. The scoop is mounted in a frame in which also resides the peripheral equipment needed to effect the scoop's raising and lowering. The lower end of the scoop in Benjamin is attached to a pair of cables which pass up to and through the top of the frame and then around take-up reels. The opposite end of the scoop is attached by a hinge to the frame at the level of the higher elevation.

Problems associated with the earlier systems include expense and lead-time requirements inherent in custom-made apparatus, complexity of the portable cable-based devices, and, in the case of the arcuate system of Benjamin, the need to keep the wheelchair unlocked during use. Even though the portable system of Booth does not require the excessive lead time and high monetary outlay of the custom-made systems, it has other significant problems. For example, the large number of pulleys required for motor-torque reasons in systems such as that of Booth increases the likelihood of component failure and consequent down-time. Furthermore, where, as in Booth, all of the components are secured to the platform, any repair to the motor, cable, or pulleys requires the disassembly of the platform for access. Although one of the touted advantages of Booth is its portability, nevertheless, from a practical viewpoint, the weight of two synchronized motors, two reduction gear boxes, multiple pulleys, cables, tracks, support members, and platform make the system somewhat burdensome to transport, to say the least.

The molded, arcuate lift system of Benjamin suffers a major regulatory disadvantage. For it to work properly, the wheelchair must be free-rolling; that is, the wheelchair wheels must not be locked. Although this system should be quite safe, it confronts a regulatory barrier in the widespread requirement that wheelchair wheels be locked during transit of the wheelchair between different levels.

Therefore, what is needed is a wheelchair lift system combining the sturdiness of a fixed system, the minimal manufacturing lead time of a portable system, and the simplicity of an arcuate molded platform lift system, while readily complying with the existing regulatory framework. What is further needed is such a system that can be installed in a stairway without precluding normal access to that stairway. What is yet further needed is such a lift system that utilizes only a small number of components and that utilizes standardized components, so as to minimize breakdown frequency and also the attendant down-time when breakdown does occur.

SUMMARY OF THE INVENTION

The wheelchair lift system of the present invention combines the security and stability of fixed lift systems with the standardization of components and ease of adjustment and assembly of a portable, cable-based lift system. The heart of the invention is a free-rolling wheelchair-supporting platform mounted on and extending between two arcuate tracks. The raising and lowering of the platform is achieved by raising and lowering the pair of arcuate tracks. If the system is installed in a stairway, full access is provided to the stairway while the arcuate tracks are in their lowered position, which is their normal rest position.

In addition to the platform and arcuate tracks, the lift system of the present invention consists of the peripheral equipment needed to support the tracks and to vary their elevation. This includes in particular a specially-designed steel portal frame which typically would consist of two trapezoidal side supports vertically connected to a top connection plate. This portal frame is secured to the floor on the lower level and constitutes the backbone support of the entire system. Two drive mechanisms, used for lifting and lowering the tracks, are secured to pivoting bracket assemblies. The drive mechanisms may have cable means, worm-gear means, or any other suitable means for achieving the raising and lowering of the tracks. The pivoting bracket assemblies are attached to the top connection plate, one directly above each side support. Each drive mechanism extends vertically downward on the outside of the portal frame supports. These drive mechanisms use pivoting joints to attach to the two arcuate tracks. Each track is located on the inside edge of a side support and is rotationally secured to a steel bracket located just below the upper level. The portal frame has openings cut into each side support through which the pivoting joints connect each track to its respective drive mechanism. The location and size of the openings in the side supports allow for the required vertical and horizontal movement of the respective pivoting joints when the system is in use. When the system is activated, the synchronized drive mechanisms raise or lower the tracks upon which a free-rolling platform rides in a steady, controlled fashion. The platform may be designed in a variety of ways, including an essentially flat plate having platform wheels that are rotatably attached to the platform by way of a support bracket. In that design the support bracket is secured to the platform on one end and has an axle on a second end to hold and support the wheels. The wheeled platform can use a variety of wheels such as metal or synthetic, ball-bearing, or any combination of wheel characteristics to achieve the desired smoothness of roll. One method of effecting the desired smoothness of roll would utilize a torsion mechanisms within the wheels. In the event of power failure, the drive mechanisms allow for a safe and controlled return to the lower level. Alternatively, the platform may be joined directly to the arcuate tracks, with the platform conforming to the change in the tracks, much like a roll-top desk.

To change from a lower floor level to an upper floor level by means of the Wheelchair Lift, the wheelchair-bound user first lowers the platform if the Wheelchair Lift is in the upper position. This is accomplished by any of a number of methods. One is by the use of a microwave-controlled device similar to that used on "radio-controlled" garage doors. Another means could be a simple electrical switch, or any other suitable means, as would be understood by those skilled in the art. Once the platform is in the lowered position, the wheelchair is rolled forward onto the platform. After locking the wheelchair wheels, the wheelchair-bound user then activates the system. Once activated, the system's synchronized, reversible, drive mechanisms cause the tracks and the attached, platform to rise. The system is designed to move sufficiently slowly and with arcuate-shaped tracks so that the free-rolling platform will slowly roll along the tracks, naturally seeking its lowest possible position. Consequently, the platform will roll slowly and smoothly along to the end of the side tracks until the platform is stopped by the upper-level floor. In order to prevent the platform from moving away from the upper-level floor, the tracks are kept at a slight upward angle relative to the upper-level floor when in the raised position. Once the wheelchair lift reaches its uppermost point, the system stops and the wheelchair-bound user can then unlock the wheels on the chair and proceed forward onto the upper level.

To return to the lower level, a similar procedure as that described above is followed. Forces similar to those governing the raising process cause the platform to slowly roll along the tracks as the tracks are lowered. When the system reaches its lower position, the rolling platform is stopped by a plate connecting the ends of the arcuate tracks. While the wheelchair lift system is in the lowered position, the connecting plate rests on the floor and is level with the rolling platform. In an alternative embodiment of the invention, the combination of the arcuate tracks and the wheelchair-supporting platform may be moved using a set of hydraulic cylinders that effectively replace the portal frame so as to permit easier access to the stairway by persons not needing the wheelchair lift. Each of the hydraulic cylinders is attached at one end to a corresponding stationary support bracket that extends along the stairs essentially from top to bottom. The other end of the hydraulic cylinder is attached to a side wall that is in turn connected to one of the arcuate tracks, each arcuate track having its own side wall. The side walls are in turn connected to a pivot bracket located at the upper region of the stairway such that when the hydraulic cylinders are operated, the side supports pivot upward or downward. In an optional design of the device using the hydraulic lift, the two side walls which are coupled together can be moved using a single hydraulic cylinder. The single hydraulic cylinder is affixed to one of the side walls and to a single stationary support bracket located on one of the two track sides.

This alternative design using standard hydraulic components and motor and pump units is robust and provides a supplemental factor of safety in the overall design of the system. In addition, the side walls may be designed of sufficient height to provide added safety by constraining the user within. That height need be no more than approximately three feet—about the height of a wheelchair—such that the user will be secure and yet will be permitted to observe the area beyond the side walls.

In summary, the present invention includes a steel portal frame to support the drive mechanisms and side tracks, a free-rolling platform, and a support bracket. Such a design allows access in particular via a stairway to a different floor level for mobile-restricted persons while still allowing normal use of the stairway by other people. Furthermore, the track system allows for cutting the length of the tracks in the field for instant adaptability to any particular stair elevations or where, absent any stairs, a transition between levels is required. The height to be traversed is limited only by the overhead clearance of a particular location, the length of the uncut tracks, and the height of the portal frame. In an alternative arrangement, the combination of a hydraulic lift system and side walls coupled to the arcuate tracks is used to replace the portal frame and drive mechanism. This alternative arrangement provides easier access to the stairway by able-bodied persons and more security to the left users.

PREFERRED EMBODIMENT

Figure 1:
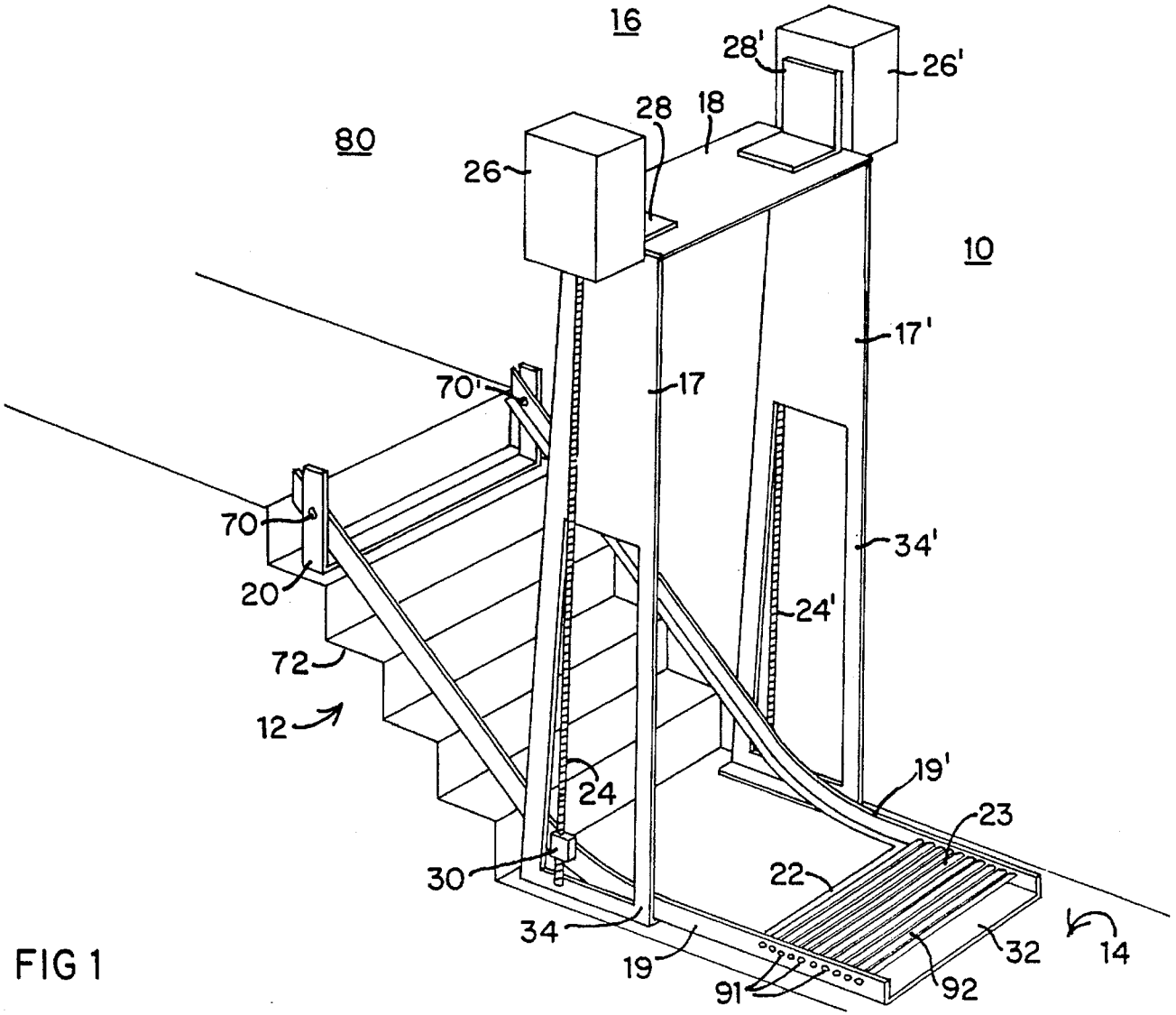
FIG. 1 is a perspective view of the wheelchair lift of the present invention showing the platform in its lowered position.
Figure 2:
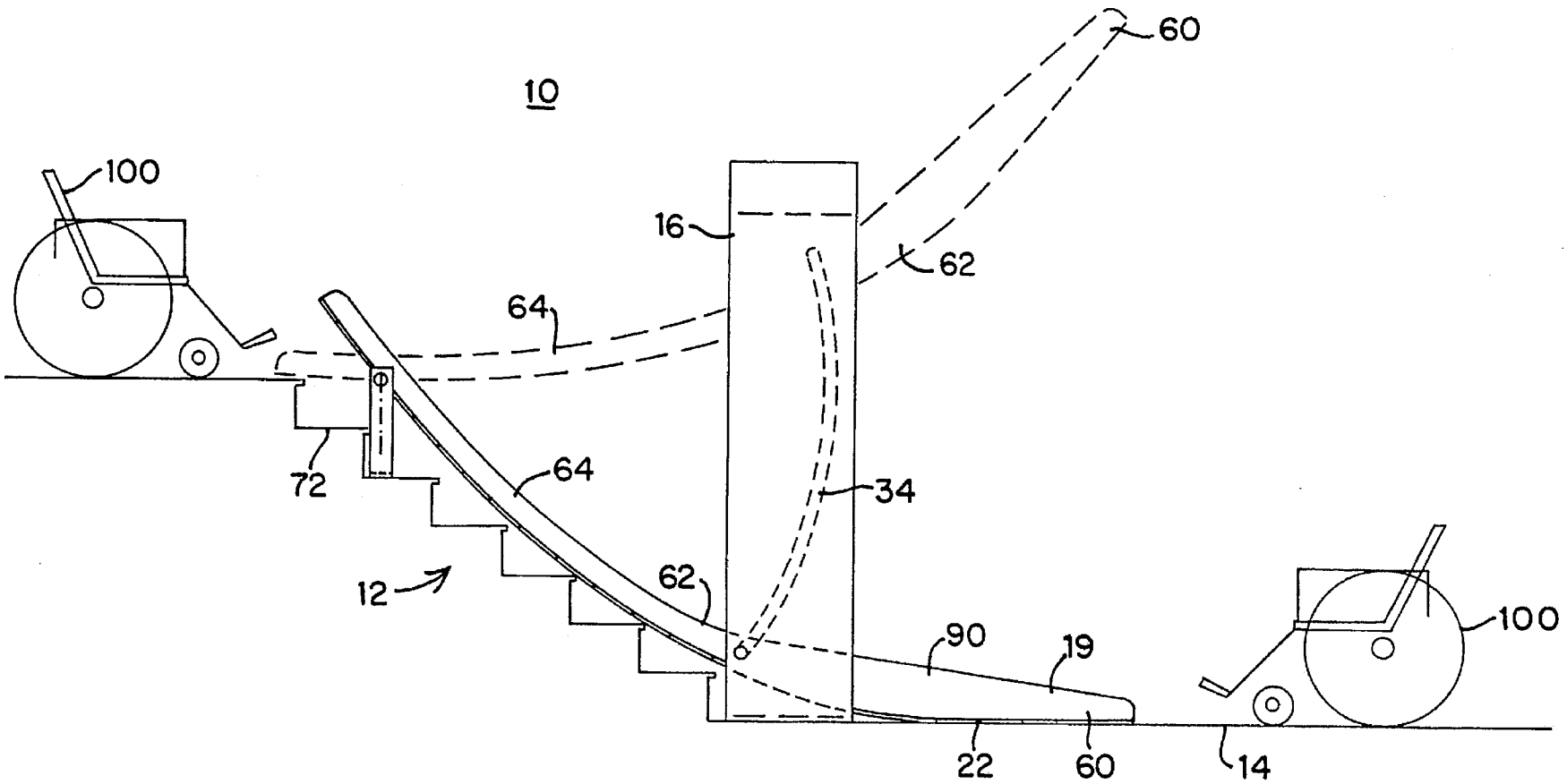
FIG. 2 is a three-positioned, diagrammatic side elevation view of the wheelchair lift of the present invention showing standard ramp requirements and positioning on a stairway.
Figure 3:
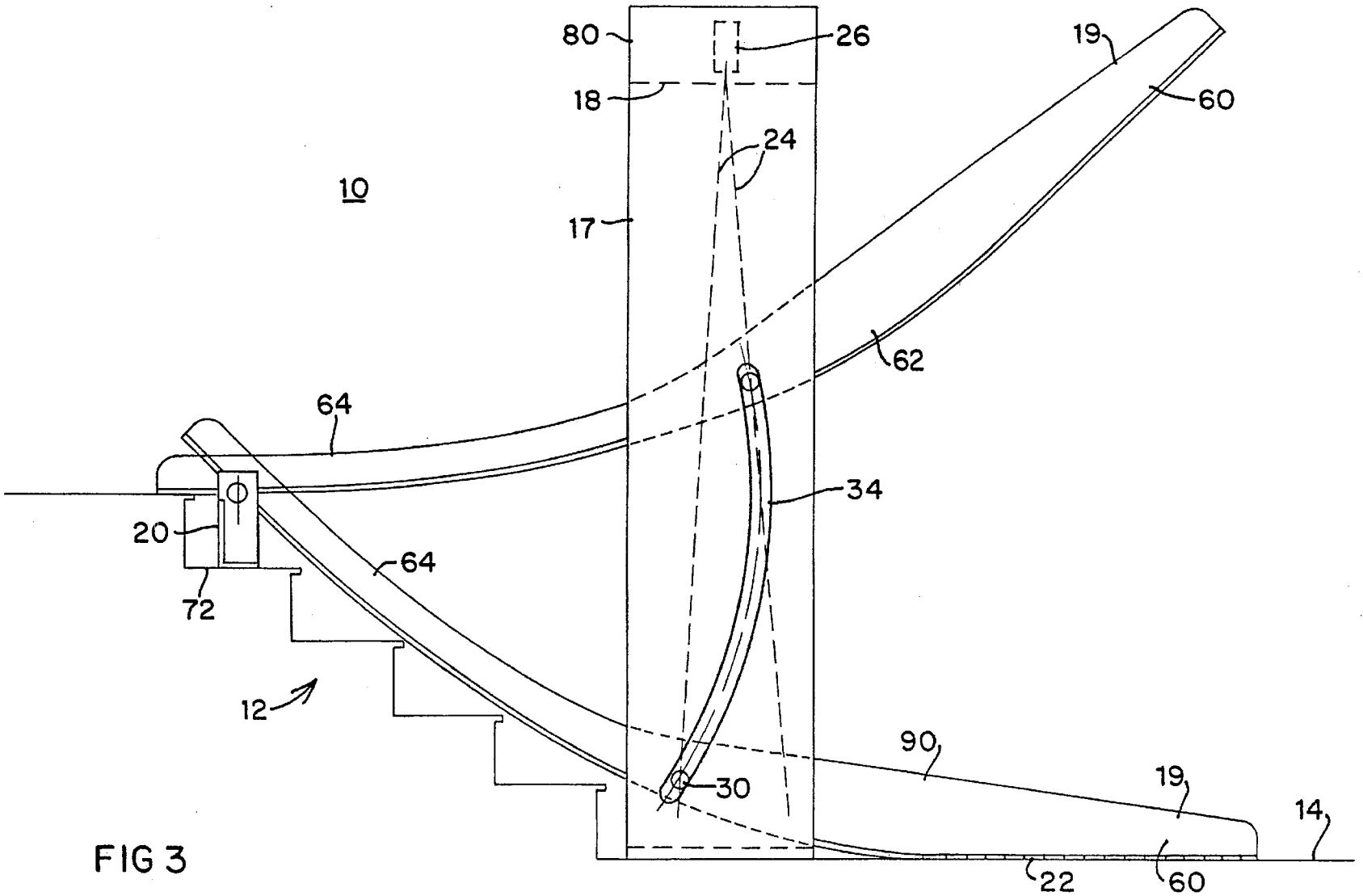
FIG. 3 is an enlarged, three-positioned, side view showing the position of the invention's worm-gear and platform position during lifting and/or lowering of the side tracks.
Figure 4:
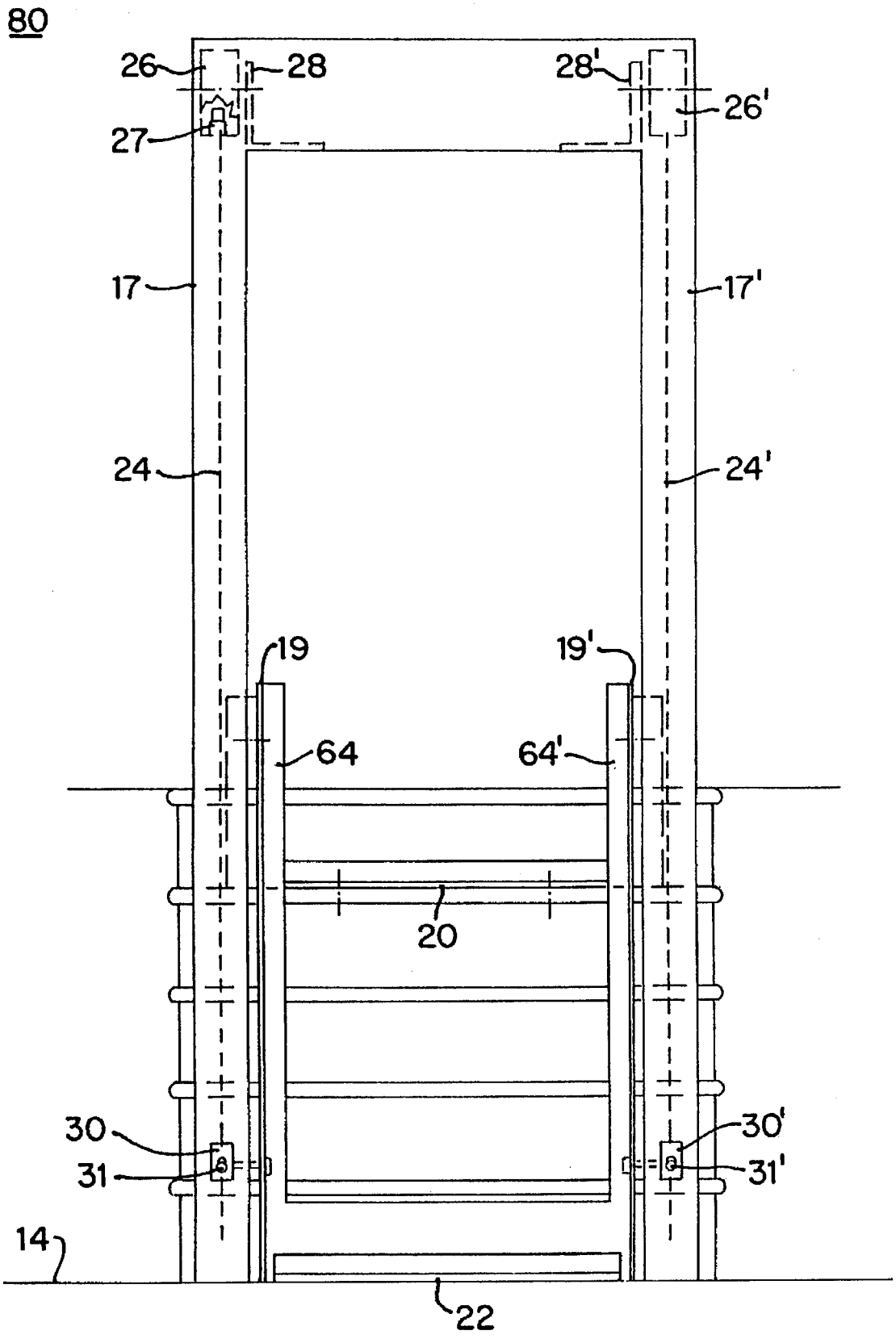
FIG. 4 is an end view of the apparatus showing the platform of the present invention in its lowered position.

The general operation of the preferred embodiment of the present invention is illustrated in FIG. 1 and FIG. 2 which shows a wheelchair lift system 10 positioned adjacent to stairway 12 and generally resting on floor 14. FIG. 3 shows simultaneous views of the different positions of a drive mechanism 80 having a first worm-gear 24, a first drive motor 26, a first pivoting, threaded worm-gear head 30, a left side arcuate track 19, and a platform 22 having means for traversing the left side track 19 and a right side arcuate track 19' and in operative engagement therewith. FIGS. 2 and 3 also show the system 10 with the platform 22 located at the top of the stairway 12 and on the floor 14. FIG. 4 shows an end view of the wheelchair lift system 10 in its lowered position with a cut-away view of the first drive motor 26 having a drive shaft 27.

The wheelchair lift system 10 includes a specially-designed steel portal frame 16 comprising a trapezoidal left side support member 17 and a trapezoidal right side support member 17' vertically connected to a top connection plate 18. The portal frame 16 is permanently secured to the floor 14 providing stability for the left track 19, the right track 19', and a mounting position for the first drive motor 26 and a second drive motor 26'. The left support 17 and the right support 17' are fabricated from ¼" thick steel plate having a base that is wider than the top where connection plate 18 is attached. The trapezoidal shape of the left side support 17 and the right side support 17' give greater stability under shifting loads during use. An example of an acceptable trapezoidal support dimension would be 18" wide at the base, 8" wide at the top, and 7" high. As will be clear from the following descriptions, the height of the portal frame 16 is important for allowing use of the stairway 12 when the wheelchair lift system 10 is in the lowered position and not in use.

Except for worm-gear access means to be described herein, the first worm-gear 24, a second worm-gear 24', the first driver motor 26, and a second drive motor 26' are preferably enclosed in housing means, as illustrated. The left support 17 has a left opening 34 providing access to the first worm-gear head 30 and the right support 17' has a right opening 34' providing access to a second pivoting, threaded worm-gear head 30'. Preferably, the openings 34 and 34' are simply slits, as shown in FIGS. 2 and 3. A first pivoting bracket assembly 28 and a second pivoting bracket assembly 28' are attached to the connection plate 18 directly above the left side support 17 and the right side support 17', respectively. The first drive motor 26 is attached to the first bracket assembly 28. A second drive motor 26' is attached to the second bracket assembly 28'. The first worm-gear 24 extends vertically downward from the drive motor 26 engaging the first worm-gear head 30 which has a threaded opening 31 and is rotatably mounted to the left track 19. Similarly, the second worm-gear 24' extends vertically downward from the second drive motor 26', engaging the second worm-gear head 30' also having a threaded opening 31' and which is rotatably mounted to the right track 19'. Also as with left track 19, right track 19' is coupled to the rolling platform 22 via rolling means 23. In the preferred embodiment of the invention the rolling means 23 connects the platform 22 to the left track 19 and the right track 19' such that the bottom of the platform 22 is flush with the bottom level of those tracks.

The first bracket assembly 28 and the second bracket assembly 28' allow for the proper lift orientation of the first worm-gear 24 to the left track 19 and a second worm-gear 24' to the right track 19', respectively. The first drive motor 26 is synchronized with the second drive motor 26' so as to provide a smooth, balanced, lifting force. The natural turning of the worm-gears under pressure provides an automatic, simultaneous, fail-safe return to the lower floor level 14 of the left track 19, the right track 19', and the platform 22 if there is a power failure. The left track 19 and the right track 19' preferably include raised sidewall sections 90 so as to eliminate any concerns regarding possible tipping of a wheelchair 100 positioned on the platform 22. The platform 22 can also be provided with a slightly raised section for the same purpose.

The left track 19 and the right track 19' are fabricated from 4"×2"×¼" angled-steel that form rails for the roller means 23 of the platform 22. In the preferred embodiment of the invention, the roller means 23 are simply end sections 91 of roller bars 92, central portions 93 of which form the platform 22. The end sections 91 of the roller bars 92 are captured within the rails of the left track 19 and the right track 19'. The roller bars 92 are themselves adjoined by links or some other well known means so as to form the platform 22 and are preferably about ⅜" diameter steel rods. The left track 19 and the right track 19' each consists of a short initial straight lower section 60, a first curved section 62 that produces the rolling action of the platform 22, and a second curved section 64, wherein the curvature of the second curved section 64 is preferably less than the curvature of the first curved section 62. The slight curvature of the second curved section 64 maintains the platform 22 in place when the left track 19 and the right track 19' are in the upper position where the wheelchair 100 would be at the top of the stairway 12. The left track 19 and the right track 19' are connected to one another at the end of the lower section 60 by a connection plate 32 that rests on the floor 14 when the system 10 is in its lowered position. The second curved section 64, shown as a left side component in FIGS. 2 and 3, and its corresponding right side second curved section 64', are preferably designed to follow the dimensions of a particular stairway and to be connected to that particular stairway. To provide this connection, a pivot hole 70 is drilled through the end of top section 64 in preparation for connecting it to a steel "U" track-support bracket 20. The track support bracket 20 is preferably made up of 4" wide×¼" thick steel channels welded together. This support bracket 20 is anchored to a first stairway tread 72 below the upper floor level. Pivot holes 70 and 70' are drilled in the field to match the riser height. By placing the support bracket 20 on the first tread 72 of the stairway 12, the device can be adjusted in the field to accommodate all standard tread and riser configurations. The left track 19 and the right track 19' are suspended above the stairway 12 so that they do not have to be perfectly parallel with the stairway 12. Any difference is corrected for by the resting location of the platform 22.

When the system 10 is in its upper position, the movement of the platform 22 along the left side track 19 and the right side track 19' is stopped by the last tread of the stairway 12 so that the platform 22 is flush with the top of the stairway 12, the left side track 19, and the right side track 19'. The designs of the left track 19 and of the right track 19' are such that, the left track 19 and the right track 19' are raised or lowered, the platform 22 naturally seeks its lowest possible position effecting movement of the platform 22 in a smooth rolling action to its final resting position.

Figure 5:
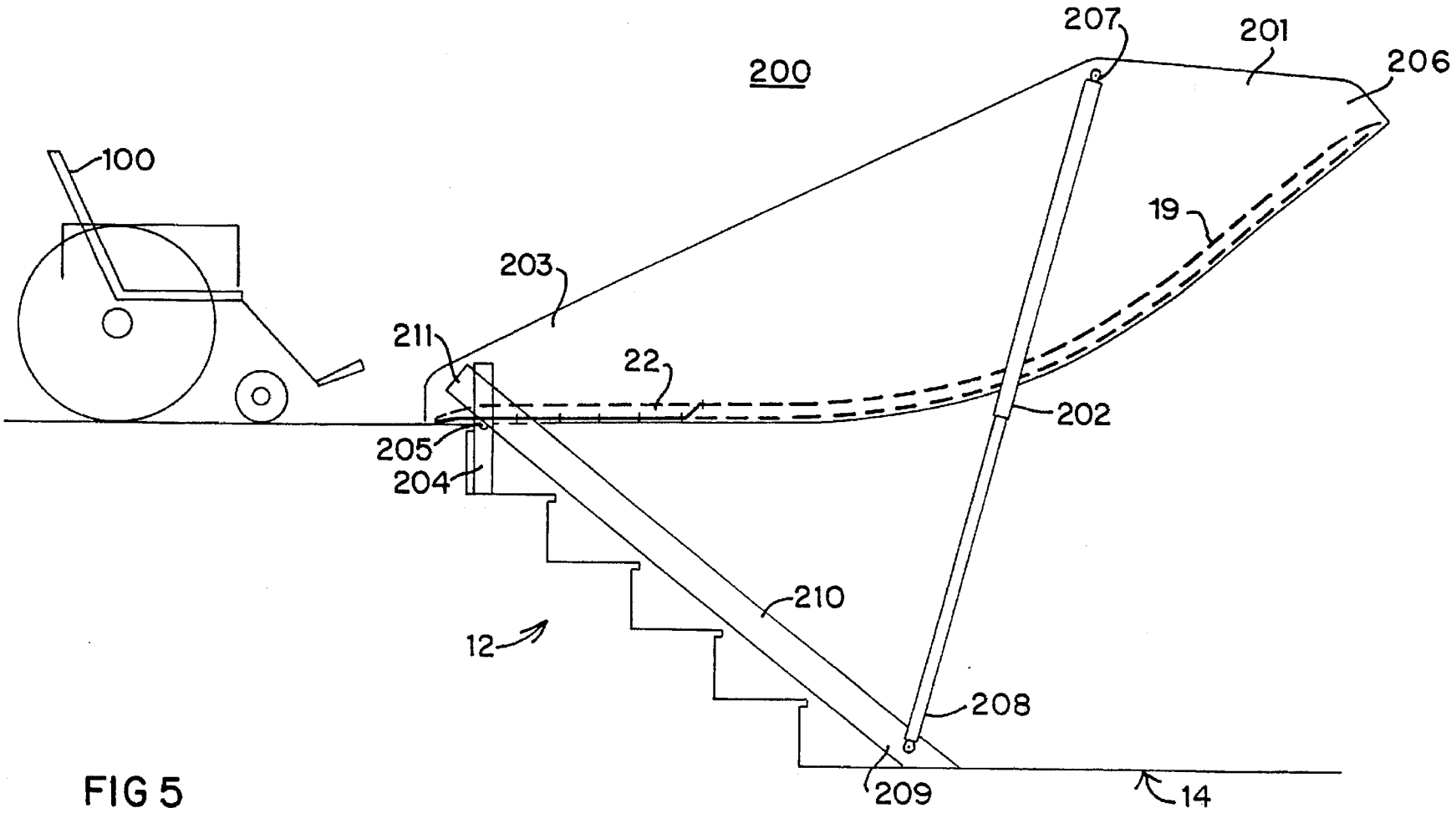
FIG. 5 is a diagrammatic side view of the alternative wheelchair lift of the present invention, showing the side-wall-and-hydraulic-cylinder assembly in the raised position.
Figure 7:
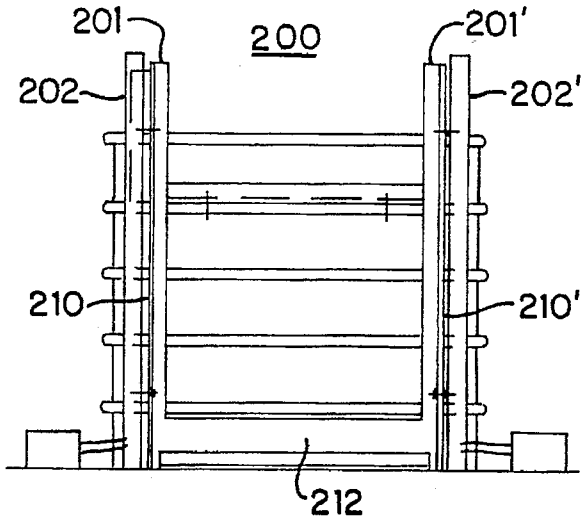
FIG. 7 is an end view of the alternative wheelchair lift showing the rolling platform in the lowered position.
Figure 6:
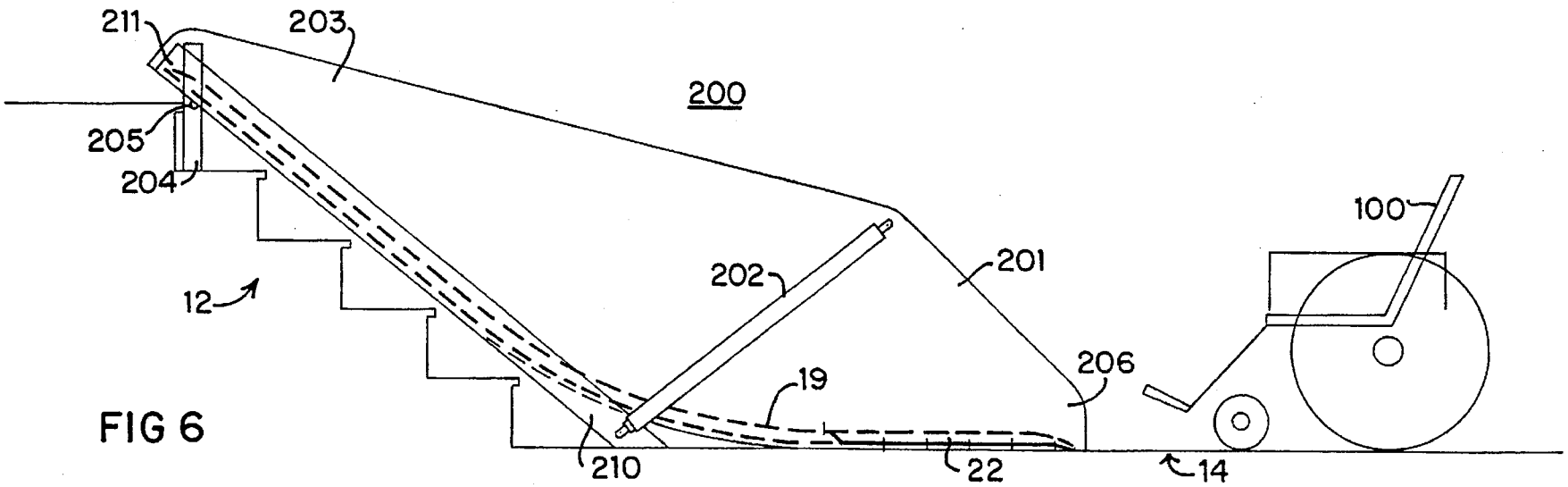
FIG. 6 is a diagrammatic side view of the alternative wheelchair lift of the present invention, showing the side-wall-and-hydraulic-cylinder assembly in the lowered position.

In an alternative design of the system 200 shown in FIGS. 5–7, the portal frame 16 is replaced by the introduction of a combination of a set of side walls including a first side wall 201 and a second side wall 201' with one or more hydraulic cylinders 202 used to move the first side wall 201 and the second side wall 201'. The first left arcuate track 19 is coupled to the first side wall 201 and the second right arcuate track 19' is coupled to the second side wall 201'. As in the design of the system 10 previously described, the rolling platform 22 remains within the arcuate tracks 19, 19' and operates in essentially the same manner. The distinguishing feature of the alternative system 200 of the present invention lies in the arrangement of the set of side walls in conjunction with the hydraulic cylinders 202. In particular, as illustrated in FIG. 5, which shows a first hydraulic cylinder 202 fully extended such that the first side wall 201 is raised to a maximum height. This position of the first side wall 201 results in movement of the platform 22 to the top of the stairway 12 via the left arcuate track 19 and the right arcuate track 19' (not shown). The wheelchair 100 can then be moved from the top of the stairway 12 onto the platform 22 for transport down to the floor 14.

The first side wall 201, like the second side wall 201', includes an upper side wall end 203 that is pivotally affixable to a first pivot bracket 204 having a first pivot pin 205 that keeps the upper side wall end 203 in position while an upper cylinder end 207 of the first hydraulic cylinder 202 moves a lower side wall end 206 either to a raised position, as shown in FIG. 5, or in a lowered positioned, as shown in FIG. 6. It is preferable to have the pivot pin 205 positioned on the pivot bracket 204 so that when the system 200 is in its maximum raised position shown in FIG. 5, the platform 22 is at a slightly downward angle so as to more easily receive the wheelchair 100. A lower cylinder end 208 of the first hydraulic cylinder 202 is maintained in a fixed position by attachment to a lower mounting bracket end 209 of a first stationary mounting bracket 210. The lower bracket end 209 of the stationary mounting bracket 210 is preferably permitted to rest on the floor 14 and is optionally secured to a cross bracket 212 that is in turn coupled to a second stationary mounting bracket 210' shown in FIG. 7. An upper bracket end 211 of the first stationary bracket 210 is coupled to the first bracket 204 and to the first side wall 201 by the pivot pin 205. The combination of the cross bracket 212 with the first stationary bracket 210 and the second stationary bracket 210' is preferably provided in sections so that the spacing between the two stationary brackets 210, 210', can be varied as required by the particular width of the stairway 12 to which the system 200 is to be attached.

The alternative system 200 shown in FIG. 7 illustrates the use of two hydraulic cylinders, one for movement of the first side wall 201, and one for the second side wall 201'. However, it is contemplated that the system 200 may be operable using only one hydraulic cylinder that may be attachable either to the first side wall 201, or to the second side wall 201', provided both side walls are securely coupled together.

Although the preferred embodiment of the present invention has been described in some detail herein, it is to be understood that this description is merely illustrative. The inventive apparatus may be modified in a variety of ways to suit a particular purpose while still employing the unique concepts set forth in the SUMMARY.

What is claimed is:

1. A wheelchair lift system for conveying a wheelchair between a lower floor and an upper floor, comprising:

a. a wheelchair-support platform;

b. a set of similar arcuate tracks, including a first arcuate track and a second arcuate track, wherein each of said arcuate tracks has an upper end and a lower end;

c. means for coupling said wheelchair-support platform to said arcuate tracks; and d. means for raising and lowering said lower end of said first arcuate track and said lower end of said second arcuate track;

wherein said wheelchair-support platform when coupled to said arcuate tracks will move along said arcuate tracks in response to a change in elevation of said lower end of each of said arcuate tracks.

2. The system as claimed in claim 1 wherein said means for coupling said platform to said arcuate tracks includes roller elements connected to said platform and to said arcuate tracks.

3. The system as claimed in claim 2 wherein each of plurality of said roller elements is connected to said platform and to said arcuate tracks.

4. The system as claimed in claim 3 wherein each of said plurality of said roller elements is connected to one of said arcuate tracks by an axle.

5. The system as claimed in claim 1 wherein said upper end of said first arcuate track and said upper end of said second arcuate track are rotatably secured to a track bracket, said bracket being securely mounted below a surface of said upper floor.

6. The system as claimed in claim 1 with said means for raising and lowering said lower end of said first arcuate track and said lower end of said second arcuate track comprising:

a. a reversible drive motor rotatably mounted to a portal frame;

b. a worm-gear affixed to a drive shaft of said drive motor; and c. a worm-gear head having a threaded opening engaging said worm-gear and rotatably mounted to said arcuate tracks.

7. The system as claimed in claim 6 with said portal frame comprising:

a. two vertical support members and means for securing first ends of said support members to said lower floor; and b. a connection plate disposed between second ends of said support members and means for attaching said connection plate to said support members.

8. The system as claimed in claim 1 wherein said system includes a microwave-controlled device for activating said means for raising and lowering said lower end of said first arcuate track and said lower end of said second arcuate track.

9. A wheelchair lift system for conveying a wheelchair between a lower floor and an upper floor, comprising:

a. a wheelchair-support platform including a plurality of roller elements connected to said platform by a support bracket;

b. a set of similar arcuate tracks, including a first arcuate track and a second arcuate track, wherein each of said arcuate tracks has an upper end and a lower end, said lower end of each of said arcuate tracks being connected together by a connection plate, and said upper end of each of said arcuate tracks being rotatably secured to a bracket;

c. means for raising and lowering said lower end of each of said arcuate tracks comprising a reversible drive motor rotatably mounted to a portal frame, a worm-gear affixed to a drive shaft of said drive motor, and a worm-gear head having a threaded opening engagable with said worm-gear and rotatably mounted to one of said arcuate tracks; and d. means for coupling said wheelchair-support platform to said arcuate tracks including a plurality of roller elements connected to said platform by a support bracket and each of said roller elements connected to said arcuate tracks by an axle;

wherein said wheelchair-support platform is designed such that when coupled to said arcuate tracks it will roll along said arcuate tracks in response to a change in elevation of said lower end of each of said arcuate tracks.

10. A method for conveying an occupied wheelchair between two horizontal levels, said method comprising the steps of:

a. placing said occupied wheelchair on a wheelchair-support platform having rolling members in operative engagement with a pair of arcuate tracks, and said platform being suspended between said pair of arcuate tracks;

b. activating reversible drive mechanisms to raise or lower said pair of arcuate tracks;

c. stopping said rolling wheelchair-support platform by an upper horizontal level when in a raised position and by a connecting means disposed between lower ends of the arcuate tracks when in a lowered position.

11. The system as claimed in claim 1 with said means for raising and lowering said lower end of said first arcuate track and said lower end of said second arcuate track comprising:

a. a set of side walls including a first side wall couplable to said first arcuate track and a second side wall couplable to said second arcuate track;

b. a hydraulic cylinder couplable to one of said side walls and to a stationary bracket positioned proximal to said lower floor; and c. means to power said hydraulic cylinder.

12. The system as claimed in claim 11 wherein said hydraulic cylinder is a first hydraulic cylinder and said stationary bracket is a first stationary bracket, wherein said first hydraulic cylinder is couplable to said first side wall and to said first stationary bracket, the system further comprising a second hydraulic cylinder couplable to said second side wall and to a second stationary bracket positioned proximal to said lower floor, wherein said second hydraulic cylinder is operable by said means to power said first hydraulic cylinder.

13. The system as claimed in claim 12 further comprising a set of pivot brackets including a first pivot bracket and a second pivot bracket, wherein said first pivot bracket is couplable to an upper first side wall end of said first side wall and to an upper first stationary bracket end of said first stationary bracket, wherein said second pivot bracket is couplable to an upper second side wall end of said second side wall and to an upper second stationary bracket end of said second stationary bracket.

14. The system as claimed in claim 13 wherein said means to power said first hydraulic cylinder and said second hydraulic cylinder is a pump and motor unit.

15. The system as claimed in claim 11 wherein the positioning of said first side wall and said second side wall with respect to one another is adjustable.

16. The system as claimed in claim 11 wherein said first side wall and said second side wall have a height of approximately three feet.

* * * * *